US011035568B1

(12) United States Patent
Ramirez

(10) Patent No.: US 11,035,568 B1
(45) Date of Patent: Jun. 15, 2021

(54) CLIMATE CONTROL LIGHT FIXTURES

(71) Applicant: Josue Ramirez, Vancouver, WA (US)

(72) Inventor: Josue Ramirez, Vancouver, WA (US)

( * ) Notice: Subject to any disclaimer, the term of this patent is extended or adjusted under 35 U.S.C. 154(b) by 0 days.

(21) Appl. No.: 17/014,790

(22) Filed: Sep. 8, 2020

(51) Int. Cl.

| | |
|---|---|
| ***F21V 33/00*** | (2006.01) |
| ***F21S 8/02*** | (2006.01) |
| ***F21V 21/04*** | (2006.01) |
| ***F24F 13/078*** | (2006.01) |
| *F21V 29/60* | (2015.01) |

(52) U.S. Cl.
CPC ..... *F21V 33/0092* (2013.01); *F21S 8/026* (2013.01); *F21V 21/049* (2013.01); *F24F 13/078* (2013.01); *F21V 29/60* (2015.01)

(58) Field of Classification Search
CPC ..... F21S 8/026; F21V 21/03; F21V 21/049; F21V 29/60; F21V 33/0092; F24F 13/078
See application file for complete search history.

(56) References Cited

U.S. PATENT DOCUMENTS 3,068,341 A * 12/1962 Ortiz ..... F24H 3/0411 219/220
4,511,113 A * 4/1985 Druffel ..... F21S 8/02 248/216.4
4,681,024 A * 7/1987 Ivey ..... F24H 3/0411 219/220
5,597,233 A * 1/1997 Lau ..... F21S 8/026 362/294
6,095,671 A * 8/2000 Hutain ..... F21V 29/507 362/373
7,203,416 B2 * 4/2007 Craw ..... F24H 3/0411 392/350
7,618,168 B1 * 11/2009 Buse ..... F21V 31/03 362/264
7,926,997 B1 * 4/2011 Miller ..... F21S 8/026 362/576
8,651,704 B1 * 2/2014 Gordin ..... F21V 33/0092 362/294
8,961,126 B1 * 2/2015 Tom ..... F24F 13/078 415/213.1
2013/0272002 A1 * 10/2013 Craw ..... F21V 29/67 362/373
2013/0315731 A1 * 11/2013 Yang ..... F04D 29/601 416/5
2018/0023803 A1 * 1/2018 Gong ..... F21V 23/06 362/96
2018/0066838 A1 * 3/2018 Huang ..... F04D 29/282

* cited by examiner

*Primary Examiner* — Zheng Song
(74) *Attorney, Agent, or Firm* — Mohr Intellectual Property Law Solutions, PC

(57) ABSTRACT

Climate control light fixtures for supporting and powering a light device and for mounting to a wall or a ceiling with access to a forced air climate control system. The climate control light fixture includes a housing and a vent. The housing is configured to mount to the wall or the ceiling. The housing includes a port and a body. The port is configured to fluidly couple to the forced air climate control system. The body is attached to the port and in fluid communication with the port. The vent is configured to selectively mount to the body of the housing. The vent defines a vent opening and a light opening. The light opening is configured to receive the light device. The vent is in fluid communication with the forced air climate control system via the housing when the vent is selectively mounted to the housing.

20 Claims, 4 Drawing Sheets

CLIMATE CONTROL LIGHT FIXTURES

BACKGROUND

The present disclosure relates generally to light fixtures. In particular, climate control light fixtures are described.

Light fixtures serve to support lighting devices on walls or ceilings. There are a wide variety of light fixture styles. One popular style is a recessed light fixture that is configured to position a lighting device substantially flush with the surface of a wall or ceiling. With recessed light fixtures, the fixture is typically disposed substantially behind a wall or ceiling out of view.

Climate control systems (also known as HVAC systems) function to heat and cool a space by directing heated or cooled air into the space. Climate control systems include ducts running through walls, ceilings, or floors and vents in fluid communication with the ducts. The vents are disposed in walls, ceilings, and floors to release the heated or cooled air from the ducts into a space. Conventional vents in heating and cooling systems tend to be utilitarian, not very attractive, and sometimes located in inconvenient locations.

It would be desirable to reduce the number of openings formed into walls, ceilings, and floors for utilitarian purposes like light fixtures and vents. Also desirable would be reducing or eliminating the need for single purpose HVAC vents in a space. Another aspiration is to replace aesthetically unappealing utilitarian HVAC vents with a more aesthetically pleasing solution. It would be further desirable to combine or integrate lighting and climate control systems for more elegant options to light and maintain a desired temperature in a space.

Thus, there exists a need for climate control light fixtures to improve upon and advance the design of known light fixtures and climate control systems. Examples of new and useful climate control light fixtures relevant to the needs existing in the field are discussed below.

SUMMARY

The present disclosure is directed to climate control light fixtures for supporting and powering a light device and for mounting to a wall or a ceiling with access to a forced air climate control system. The climate control light fixture includes a housing and a vent. The housing is configured to mount to the wall or the ceiling. The housing includes a port and a body. The port is configured to fluidly couple to the forced air climate control system. The body is attached to the port and in fluid communication with the port. The vent is configured to selectively mount to the body of the housing. The vent defines a vent opening and a light opening. The light opening is configured to receive the light device. The vent is in fluid communication with the forced air climate control system via the housing when the vent is selectively mounted to the housing. In some examples, the climate control light fixture includes a junction box.

DETAILED DESCRIPTION

Figure 1:
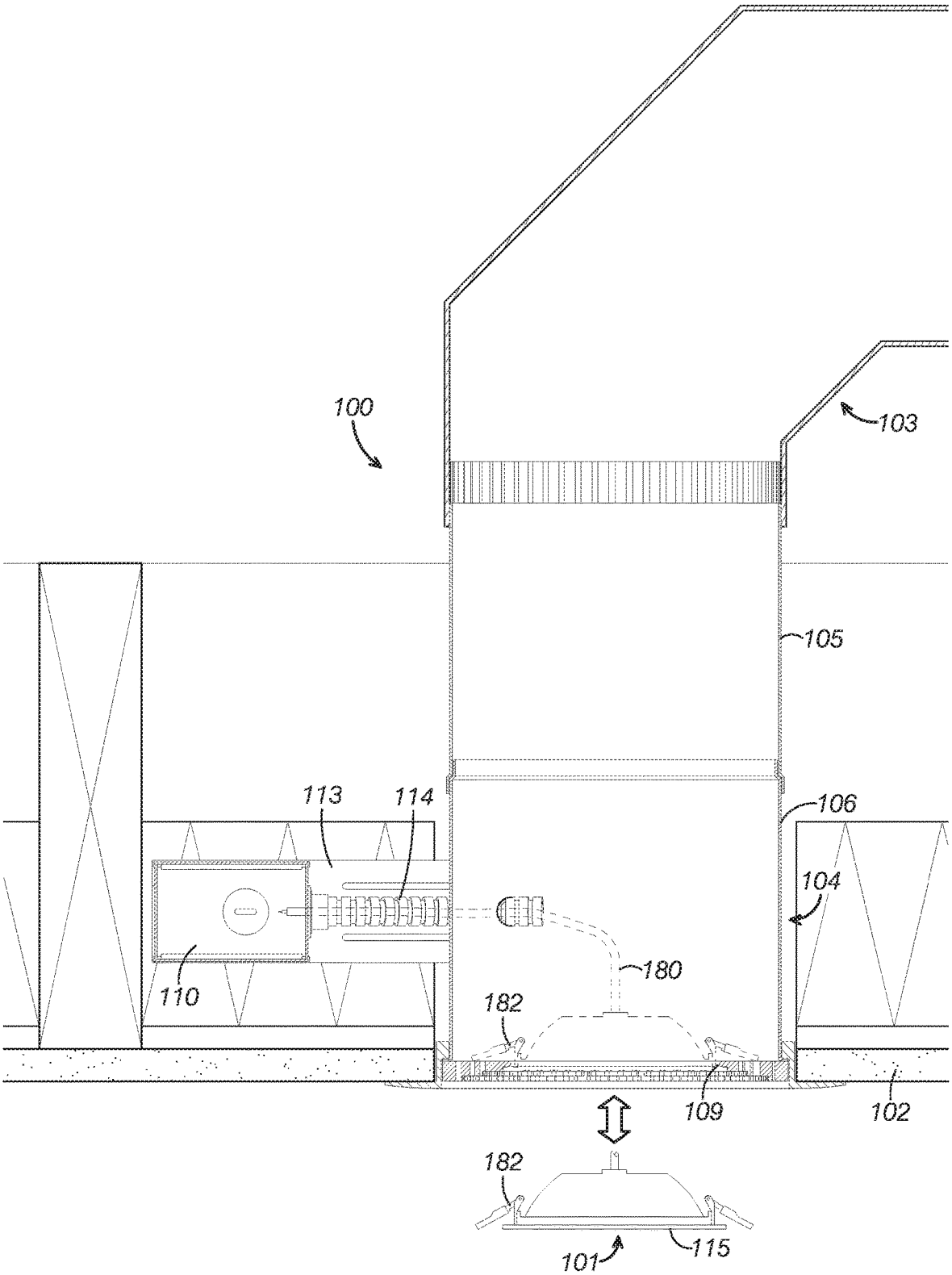
FIG. 1 is a front elevation view of a first embodiment of a climate control light fixture mounted to a ceiling with a vent flush with the ceiling and a port fluidly connected to a forced air climate control system.

The disclosed climate control light fixtures will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various climate control light fixtures are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Climate Control Light Fixtures

With reference to the figures, climate control light fixtures will now be described. The climate control light fixtures discussed herein function to support a light device on a wall or ceiling and to couple the light device with a power source. The climate control light fixtures discussed herein function to fluidly couple with a climate control system and to vent climate controlled air into a space. Another function of the climate control light fixtures is to combine a light fixture and a climate control system vent.

The reader will appreciate from the figures and description below that the presently disclosed climate control light fixtures address many of the shortcomings of conventional climate control systems and light fixtures.

For example, the climate control light fixtures reduce the number of openings formed into walls, ceilings, and floors for utilitarian purposes like light fixtures and vents. The fixtures described herein reduce or eliminate the need for single purpose HVAC vents in a space. The climate control light fixtures advantageously replace aesthetically unappealing utilitarian HVAC vents with a more aesthetically pleasing solution. Further, the climate control light fixtures combine or integrate lighting and climate control systems for more elegant options to light and maintain a desired temperature in a space.

Contextual Details

Ancillary features relevant to the climate control light fixtures described herein will first be described to provide context and to aid the discussion of the climate control light fixtures.

Power Source

The climate control light fixtures described herein receive power from a power source. In the present example, the power source is electrical mains power available to a building and distributed through building wiring.

However, the power source may be any currently known or later developed type of power source. The reader will appreciate that a variety of power source types exist and could be used in place of mains power supplied to a building. In addition to the types of power sources existing currently, it is contemplated that the climate control light fixture described herein could incorporate new types of power sources developed in the future.

Climate Control Light Fixture

With reference to FIGS. 1-4, a first example of a climate control light fixture, a climate control light fixture 100, will now be described. Climate control light fixture 100 supports and powers a light device 101 and mount to a wall or a ceiling 102. As shown in FIG. 1, ceiling 102 has access to a forced air climate control system 103.

The reader can see in FIGS. 1-4 that climate control light fixture 100 includes a housing 104, a vent 107, a junction box 110, wires 180, and a light device 101. In other examples, the climate control light fixture includes fewer components than depicted in the figures, such as not including a junction box, wires, or a light device. In certain examples, the climate control light fixture includes additional or alternative components than depicted in the figures.

Housing

Housing 104 serves to fasten climate control light fixture 100 to a wall or ceiling 102. Housing 104 also functions to support other components of climate control light fixture 100, including vent 107. Another function of housing 104 is to provide a path for climate controlled air to pass to vent 107.

The reader can see in FIG. 1 that housing is configured to mount to the wall or ceiling 102. In the present example, as can be seen in FIG. 1, housing 104 is configured to be recessed within the wall or ceiling 102 to which it mounts.

As depicted in FIGS. 1-4, housing 104 includes a port 105, a body 106, an arm 113, and a wire conduit 114. In some examples, the housing includes fewer components, such as not including an arm or a wire conduit. In other examples, the housing includes additional or alternative components.

The size of housing may be varied as needed for a given application. In some examples, the housing is larger relative to the other components than depicted in the figures. In other examples, the housing is smaller relative to the other components than depicted in the figures. Further, the readers should understand that housing and the other components may all be larger or smaller than described herein while maintaining their relative proportions.

In the present example housing 104 is composed of metal. However, the housing may be composed of any currently known or later developed material suitable for the applications described herein for which it is used. Suitable materials include metals, polymers, ceramics, wood, and composite materials.

The housing may be any currently known or later developed type of housing. The reader will appreciate that a variety of housing types exist and could be used in place of the housing shown in the figures. In addition to the types of housing existing currently, it is contemplated that the climate control light fixtures described herein could incorporate new types of housing developed in the future.

The shape of the housing may be adapted to be different than the specific examples shown in the figures to suit a given application. For example, the housing may include a face having the shape of a regular or irregular polygon, such as a circle, oval, triangle, square, rectangle pentagon, and the like. Additionally or alternatively, the housing may include a face having an irregular shape. In three dimensions, the shape of the housing may be a sphere, a pyramid, a cone, a cube, and variations thereof, such as a hemisphere or a frusto-conical shape.

The role of port 105 is to fluidly couple body 106 with climate control system 103. In particular, as shown in FIG. 1, port 105 is configured to fluidly couples body 106 with a duct of forced air climate control system 103. With reference to FIGS. 1-4, the reader can see that port 105 is in line with body 106. In other examples, the port extends transverse to the body.

The number of ports in climate control light fixture may be selected to meet the needs of a given application. The reader should understand that the number of ports may be different in other examples than is shown in the figures. For instance, some climate control light fixture examples include additional or fewer ports than described in the present example.

The shape of the port may be adapted to be different than the specific examples shown in the figures to suit a given application. For example, the port may include a face having the shape of a regular or irregular polygon, such as a circle, oval, triangle, square, rectangle pentagon, and the like. Additionally or alternatively, the port may include a face having an irregular shape. In three dimensions, the shape of the port may be a sphere, a pyramid, a cone, a cube, and variations thereof, such as a hemisphere or a frusto-conical shape.

The size of port may be varied as needed for a given application. In some examples, the port is larger relative to the other components than depicted in the figures. In other examples, the port is smaller relative to the other components than depicted in the figures. Further, the readers should understand that port and the other components may all be larger or smaller than described herein while maintaining their relative proportions.

In the present example port 105 is composed of metal. However, the port may be composed of any currently known or later developed material suitable for the applications described herein for which it is used. Suitable materials include metals, polymers, ceramics, wood, and composite materials.

The port may be any currently known or later developed type of port. The reader will appreciate that a variety of port types exist and could be used in place of the port shown in the figures. In addition to the types of ports existing currently, it is contemplated that the climate control light fixture described herein could incorporate new types of ports developed in the future.

Body

Figure 2:
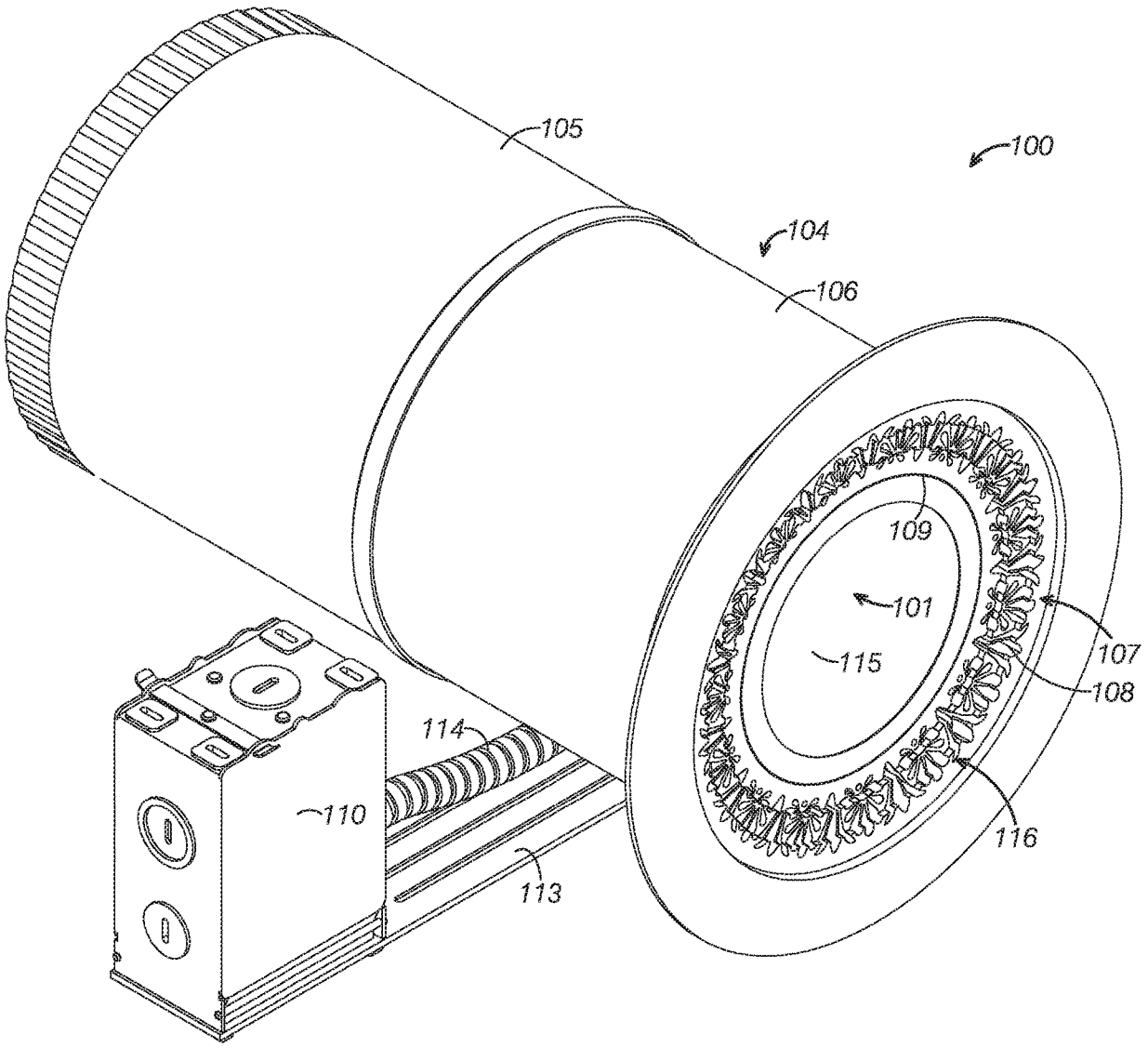
FIG. 2 is a bottom front perspective view of the climate control light fixture shown in FIG. 1 depicting the vent having a stepped, frusto-conical shape.
Figure 3:
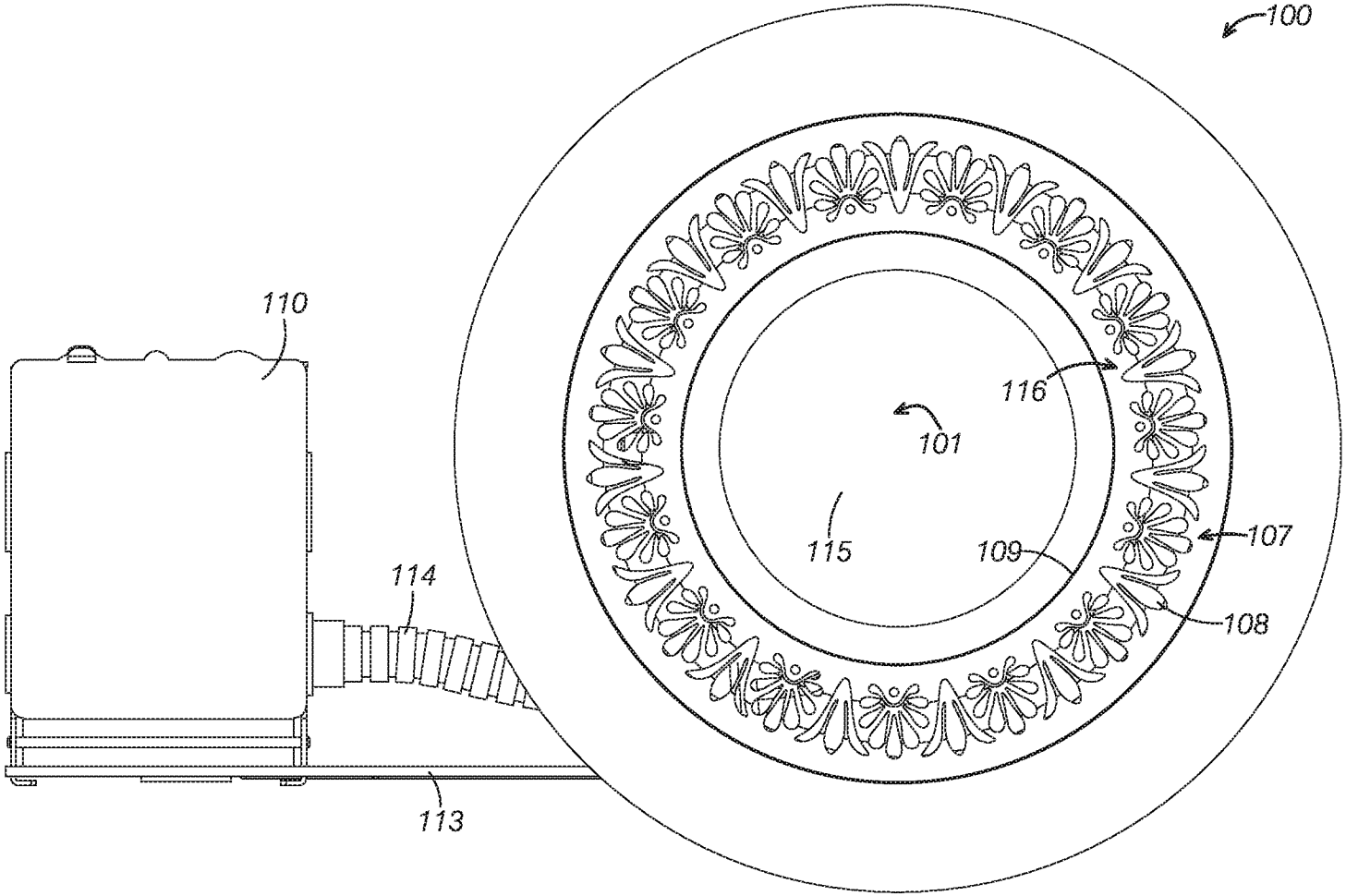
FIG. 3 is a bottom plan view of the climate control light fixture shown in FIG. 1 depicting a light device mounted to the vent and the vent having a decorative pattern.

Body 106 functions to support vent 107, port 105, arm 113, and wire conduit 114. As shown in FIGS. 1, 2 and 3, a body is attached to port 105 and is in fluid communication with port 105.

The body may be any currently known or later developed type of body. The reader will appreciate that a variety of body types exist and could be used in place of the body shown in the figures. In addition to the types of bodies existing currently, it is contemplated that the climate control light fixture described herein could incorporate new types of bodies developed in the future.

In the present example body 106 is composed of metal. However, the body may be composed of any currently known or later developed material suitable for the applications described herein for which it is used. Suitable materials include metals, polymers, ceramics, wood, and composite materials.

In the present example, body 106 is in the shape of a cylinder. However, the shape of the body may be adapted to be different than the specific examples shown in the figures to suit a given application. For example, the body may include a face having the shape of a regular or irregular polygon, such as a circle, oval, triangle, square, rectangle pentagon, and the like. Additionally or alternatively, the body may include a face having an irregular shape. In three dimensions, the shape of the body may be a sphere, a pyramid, a cone, a cube, and variations thereof, such as a hemisphere or frusto-conical.

The size of body may be varied as needed for a given application. In some examples, the body is larger relative to the other components than depicted in the figures. In other examples, the body is smaller relative to the other components than depicted in the figures. Further, the readers should understand that body and the other components may all be larger or smaller than described herein while maintaining their relative proportions.

Arm

Arm 113 functions to support junction box 110 in a position outside housing 104. Supporting junction box 110 outside housing 104 separates electrical connections to the power system from climate control system 103, which may be required by local building codes. Where requirements for junction boxes or electrical connections to be separate from the fluid flow path of a climate control system do not exist, the junction box could be disposed in the housing or the connection to mains power could occur within the housing without a junction box.

With reference to FIGS. 1-4, the reader can see that arm 113 is coupled to body 106. Arm 113 is also coupled to junction box 110. The length of the arm may be varied to provide a desired separation distance.

In the example shown in FIGS. 1-4, arm 113 is metal. However, the arm may be composed of any currently known or later developed material suitable for the applications described herein for which it is used. Suitable materials include metals, polymers, ceramics, wood, and composite materials.

Wire Conduit

Wire conduit 114 serves to isolate and protect wires 180 as they extend from junction box 110 to body 106. As shown in FIGS. 1-4, wire conduit 114 extends between body 106 and junction box 110.

The wire conduit may be any currently known or later developed type of wire conduit. The reader will appreciate that a variety of wire conduit types exist and could be used in place of the wire conduit shown in the figures. In addition to the types of wire conduit existing currently, it is contemplated that the climate control light fixture described herein could incorporate new types of wire conduit developed in the future.

In the present example wire conduit 114 is composed of metal. However, the wire conduit may be composed of any currently known or later developed material suitable for the applications described herein for which it is used. Suitable materials include metals, polymers, ceramics, wood, and composite materials.

The size of the wire conduit may be varied as needed for a given application. In some examples, the wire conduit is larger relative to the other components than depicted in the figures. In other examples, the wire conduit is smaller relative to the other components than depicted in the figures. Further, the readers should understand that the wire conduit and the other components may all be larger or smaller than described herein while maintaining their relative proportions.

Wires

Figure 4:
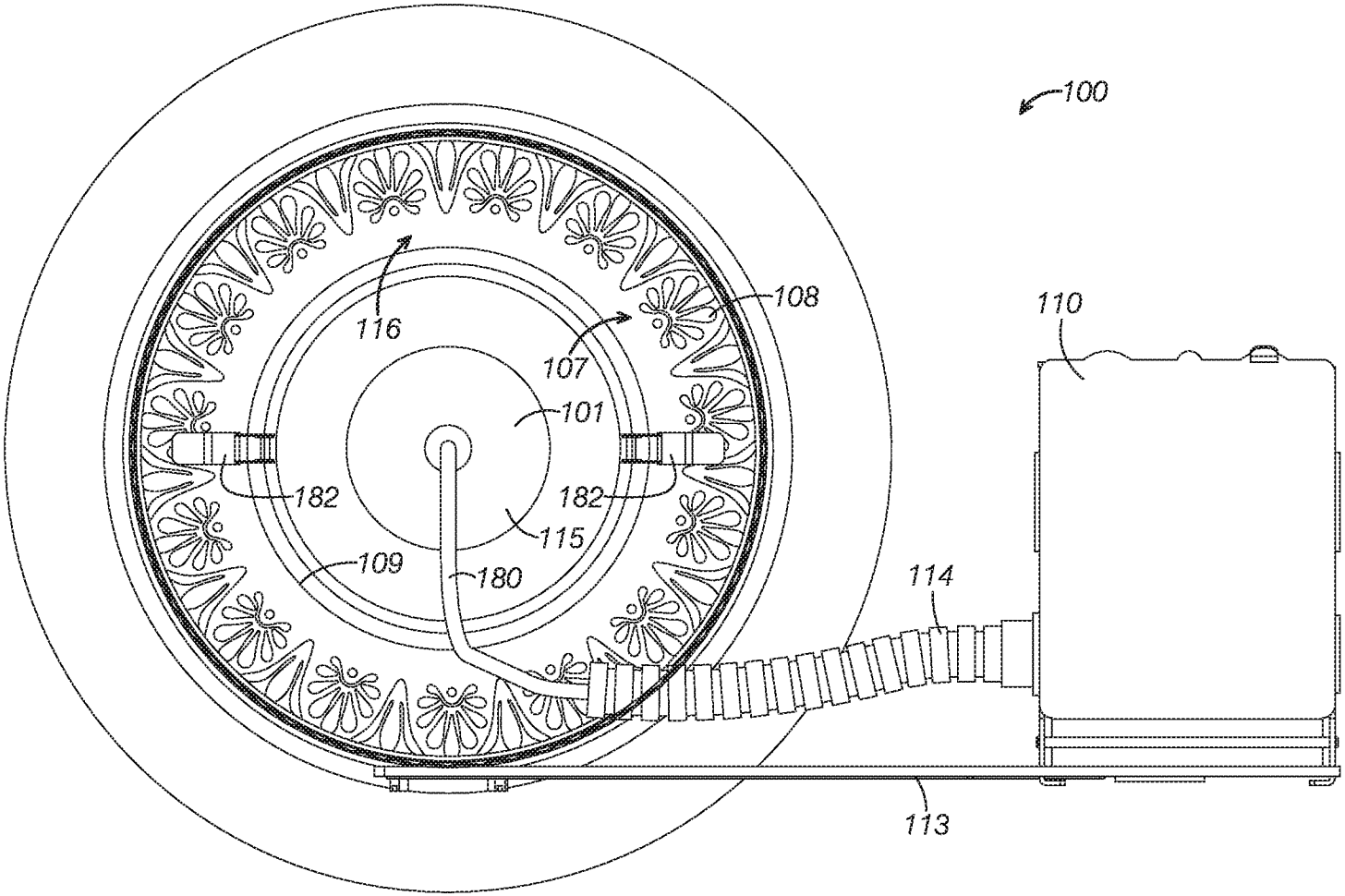
FIG. 4 is a top view of the climate control light fixture shown in FIG. 1 showing the inside of a body to depict moisture proof wires extending between the light device and into a conduit extending to an external junction box.

Wires 180 depicted in FIGS. 1-4 function to electrically couple light device 101 to a power source. In the examples shown in FIGS. 1 and 4, the wires are configured to function in the presence of moisture. As shown in FIGS. 1 and 4, light device 101 is connected to power source in junction box 110 via wires 180.

The wires may be any currently known or later developed type of wire suitable for conducting electric current to light devices. The reader will appreciate that a variety of wire types exist and could be used in place of the wires shown in the figures. In addition to the types of wires existing currently, it is contemplated that the climate control light fixture described herein could incorporate new types of wires developed in the future.

Vent

Vent 107 serves to enable climate controlled air from forced air climate control system 103 to exit climate control light fixture 100 into a space to be heated or cooled. As depicted in FIGS. 2-4, vent 107 defines a vent opening 108 and a light opening 109.

With reference to FIGS. 1 and 2, vent 107 is in fluid communication with forced air climate control system 103 via housing 104 when vent 107 is selectively mounted to housing 104. As shown in FIG. 1, vent 107 is configured to selectively mount to body 106 of housing 104. As depicted in FIG. 1, vent 107 is substantially flush with the wall or ceiling 102 when vent 107 is selectively mounted to body 106 of housing 104.

With reference to FIGS. 1 and 2, vent 107 is substantially frusto-conical. As shown in FIG. 2, vent 107 is stepped along the height of vent 107. However, the shape of the vent may be adapted to be different than the specific examples shown in the figures to suit a given application. For example, the vent may include a face having the shape of a regular or irregular polygon, such as a circle, oval, triangle, square, rectangle pentagon, and the like. Additionally or alternatively, the vent may include a face having an irregular shape. In three dimensions, the shape of the vent may be a sphere, a pyramid, a cone, a cube, and variations thereof, such as a hemisphere or a frusto-conical shape as depicted in the figures.

The size of the vent may be varied as needed for a given application. In some examples, the vent is larger relative to the other components than depicted in the figures. In other examples, the vent is smaller relative to the other components than depicted in the figures. Further, the readers should understand that the vent and the other components may all be larger or smaller than described herein while maintaining their relative proportions.

In the present example, vent 107 is formed from a plastic material 117. However, the vent may be composed of any currently known or later developed material suitable for the applications described herein for which it is used. Suitable materials include metals, polymers, ceramics, wood, and composite materials.

The vent may be any currently known or later developed type of vent. The reader will appreciate that a variety of vent types exist and could be used in place of the vent shown in the figures. In addition to the types of vents existing currently, it is contemplated that the climate control light fixture described herein could incorporate new types of vents developed in the future.

Light Opening

The reader can see in FIGS. 2-4 that a light opening 109 is configured to receive light device 101. Light opening 109 is complementarily configured with light device 101.

In the present example, light opening 109 is circular. However, the shape of the light opening may be adapted to be different than the specific examples shown in the figures to suit a given application. For example, the vent may include a face having the shape of a regular or irregular polygon, such as a circle, oval, triangle, square, rectangle pentagon, and the like. Additionally or alternatively, the light opening may include a face having an irregular shape. In three dimensions, the shape of vent may be a sphere, a pyramid, a cone, a cube, and variations thereof, such as a hemisphere or a frusto-conical shape.

Vent Openings

The role of vent openings 108 is to provide a pathway for HVAC treated air to exit climate control system 103 via climate control light fixture 100 into a desired space.

In the example shown in FIGS. 2-4, vent openings 108 are disposed between body 106 of housing 104 and light opening 109 when vent 107 is selectively mounted to body 106 of housing 104. With reference to FIGS. 2-4, vent openings 108 surround light opening 109. However, the reader should understand that the vent openings could be surrounded by the light opening in other examples. For example, if the light device is in the shape of a ring or frame, the light fixture may include vent openings surrounded by a ring or frame shaped light opening.

As depicted in FIGS. 2-4, vent openings 108 define a decorative pattern 116. However, a decorative patter is not required. In some examples, the vent openings form a regular pattern, such as a mesh or slats, or an irregular arrangement of openings. The size and shape of the vent openings may be selected to suit different ornamental and/or air flow preferences.

In the present example, vent 107 includes a plurality of vent openings 108. However, the number of vent openings in climate control light fixture may be selected to meet the needs of a given application. The reader should understand that the number of vent openings may be different in other examples than is shown in the figures. For instance, some climate control light fixture examples include additional or fewer vent openings than described in the present example.

Junction Box

Junction box 110 functions to isolate and protect wires connecting climate control light fixture 100 with a power source. As shown in FIGS. 1-4, junction box 110 provides an enclosed space to electrically couple light device 101 with a power source. The reader can see in FIGS. 1-4 that junction box 110 is operably coupled to housing 104 in a position outside body 106 of housing 104. In the present example, junction box 110 couples to arm 113 of housing 104.

The junction box may be any currently known or later developed type of junction box. The reader will appreciate that a variety of junction box types exist and could be used in place of the junction box shown in the figures. In addition to the types of junction box existing currently, it is contemplated that the climate control light fixture described herein could incorporate new types of junction box developed in the future.

The size of the junction box may be varied as needed fora given application. In some examples, the junction box is larger relative to the other components than depicted in the figures. In other examples, the junction box is smaller relative to the other components than depicted in the figures. Further, the readers should understand that the junction box and the other components may all be larger or smaller than described herein while maintaining their relative proportions.

Light Device

Light device 101 functions to emit visible light when powered by an electric current. As depicted in FIGS. 2-4, light device 101 is mounted to vent 107 in light opening 109. In the present example, light device 101 is configured to function in the presence of moisture.

As depicted in FIGS. 2-4, light device 101 is a light emitting diode 115. However, the light device may be any currently known or later developed type of light device. The reader will appreciate that a variety of light device types exist and could be used in place of the light device shown in the figures. In addition to the types of light device existing currently, it is contemplated that the climate control light fixture described herein could incorporate new types of light device developed in the future.

As shown in FIG. 4, light device 101 is configured to selectively mount to vent 107 and to be selectively removed from vent 107 with the aid of clips 182. Any suitable means for selectively mounting and removing the light device from the body may be employed, such as friction fits, mechanical fasteners, hook-and-loop fasteners, adhesives, and magnetic couplers.

The size of the light device may be varied as needed for a given application. In some examples, the light device is larger relative to the other components than depicted in the figures. In other examples, the light device is smaller relative to the other components than depicted in the figures. Further, the readers should understand that the light device and the other components may all be larger or smaller than described herein while maintaining their relative proportions.

The shape of the light device may be adapted to be different than the specific examples shown in the figures to suit a given application. For example, the light device may include a face having the shape of a regular or irregular polygon, such as a circle, oval, triangle, square, rectangle pentagon, and the like. Additionally or alternatively, the light device may include a face having an irregular shape. In three dimensions, the shape of the light device may be a sphere, a pyramid, a cone, a cube, and variations thereof, such as a hemisphere or frusto-conical.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A climate control light fixture for supporting and powering a light device and for mounting to a wall or a ceiling with access to a forced air HVAC climate control system that generates heated or cooled air that is distributed through a plurality of ducts to a plurality of vents, wherein each one of the plurality of vents discharge the heated or cooled air into a corresponding space of each one of the plurality of vents, the climate control light fixture comprising:

a housing configured to mount to the wall or the ceiling, the housing including:

a port configured to fluidly couple a first duct of the forced air HVAC climate control system, wherein the port receives the heated air or the cooled air from the duct of the HVAC climate control system, and a body attached to the port and in fluid communication with the port, wherein the body receives the heated air or the cooled air from the port;

a vent configured to selectively mount to the body of the housing, wherein the vent receives the heated air or the cooled air from the body, the vent defining:

a vent opening that is directed into the corresponding space of the vent, and a light opening configured to receive the light device;

wherein the vent is in fluid communication with the forced air HVAC climate control system via the housing when the vent is selectively mounted to the housing, wherein the climate control light fixture directs the heated air or the cooled air received from the HVAC climate control system into the corresponding space via the vent.

2. The climate control light fixture of claim 1, further comprising a junction box configured to electrically couple the light device with a power source.

3. The climate control light fixture of claim 2, wherein the junction box is operably coupled to the housing in a position outside the body of the housing.

4. The climate control light fixture of claim 3, wherein the housing includes an arm coupled to the body and coupled to the junction box.

5. The climate control light fixture of claim 4, wherein the arm is metal.

6. The climate control light fixture of claim 2, wherein the housing further comprises a wire conduit extending between the body and the junction box.

7. The climate control light fixture of claim 1, further comprising the light device mounted to the vent in the light opening, wherein the light device directs light into the first space concurrently with the heated air or the cooled air received from the HVAC system that is directed into the corresponding space by the vent.

8. The climate control light fixture of claim 7, wherein the light device is configured to function in the presence of moisture.

9. The climate control light fixture of claim 8, further comprising wires configured to function in the presence of moisture electrically coupled to the light device.

10. The climate control light fixture of claim 7, wherein the light device is a light emitting diode.

11. The climate control light fixture of claim 7, wherein the light device is configured to selectively mount to the vent and to be selectively removed from the vent.

12. The climate control light fixture of claim 1, wherein the vent opening defines a decorative pattern.

13. The climate control light fixture of claim 1, wherein the vent opening surrounds the light opening.

14. The climate control light fixture of claim 1, wherein the vent opening is disposed between the body of the housing and the light opening when the vent is selectively mounted to the body of the housing.

15. The climate control light fixture of claim 1, wherein the vent is formed from a plastic material.

16. The climate control light fixture of claim 1, wherein the housing is configured to be recessed within the wall or the ceiling to which it mounts.

17. The climate control light fixture of claim 16, wherein the vent is substantially flush with the wall or the ceiling when the vent is selectively mounted to the body of the housing.

18. The climate control light fixture of claim 1, wherein the port extends in line with the body.

19. The climate control light fixture of claim 1, wherein the vent is substantially frusto-conical.

20. The climate control light fixture of claim 19, wherein the vent is stepped along the height of the vent.

* * * * *